US008505165B2

(12) United States Patent
Domenig et al.

(10) Patent No.: US 8,505,165 B2
(45) Date of Patent: Aug. 13, 2013

(54) DAMPING MECHANISM FOR CABINET HINGE ASSEMBLY

(75) Inventors: Georg Domenig, Kernersville, NC (US); Jeffery Morgan, High Point, NC (US); Tony Hayes, Lexington, NC (US); Manfred Peer, Walkertown, NC (US); Markus Herper, Muehltal/Frankenhausen (DE)

(73) Assignee: Grass America, Inc., Kernersville, NC (US)

( * ) Notice: Subject to any disclaimer, the term of this patent is extended or adjusted under 35 U.S.C. 154(b) by 65 days.

(21) Appl. No.: 12/812,092

(22) PCT Filed: Jan. 14, 2009

(86) PCT No.: PCT/US2009/030942

§ 371 (c)(1),
(2), (4) Date: Sep. 29, 2010

(87) PCT Pub. No.: WO2009/094272

PCT Pub. Date: Jul. 30, 2009

(65) Prior Publication Data

US 2011/0005032 A1 Jan. 13, 2011

Related U.S. Application Data

(60) Provisional application No. 61/022,585, filed on Jan. 22, 2008, provisional application No. 61/049,084, filed on Apr. 30, 2008, provisional application No. 61/060,167, filed on Jun. 10, 2008.

(51) Int. Cl.
*E05F 1/08* (2006.01)

(52) U.S. Cl.
USPC ..... 16/286; 16/354

(58) Field of Classification Search
USPC ..... 16/286, 287, 288, 54, 56, 366, 370, 16/371, 354
See application file for complete search history.

(56) References Cited

U.S. PATENT DOCUMENTS

| | | | | |
|---|---|---|---|---|
| 3,256,554 | A | 6/1966 | Turner | |
| 4,979,265 | A * | 12/1990 | Grass | 16/291 |
| 5,012,551 | A | 5/1991 | Beneke | |
| 5,269,043 | A * | 12/1993 | Yang | 16/68 |
| 6,408,483 | B1 | 6/2002 | Salice | |

(Continued)

FOREIGN PATENT DOCUMENTS

| | | |
|---|---|---|
| CN | 2066062 U | 11/1990 |
| DE | 199210092 | 11/1992 |
| DE | 20 2005 002 609 U1 | 5/2005 |
| WO | 2004/020771 A1 | 3/2004 |
| WO | 2007/131933 A1 | 11/2007 |

OTHER PUBLICATIONS

Chinese Office Action (with English translation), Chinese Patent Application No. 2009801034074, dated Aug. 31, 2012 (15 pages).

(Continued)

*Primary Examiner* — Chuck Y. Mah
(74) *Attorney, Agent, or Firm* — Burr & Brown

(57) ABSTRACT

A hinge assembly is provided to mount a door to a housing, and includes a housing fixation section (1), a hinge cup (3) pivotally connected to the housing fixation section (1), and a damping mechanism (4) positioned entirely within the hinge cup (3) to dampen movement of the door as it closes on the housing.

19 Claims, 18 Drawing Sheets

(56) References Cited

U.S. PATENT DOCUMENTS

| | | | | |
|---|---|---|---|---|
| 6,629,738 | B2 | 10/2003 | Salice | |
| 6,684,453 | B2 | 2/2004 | Wang | |
| 6,846,053 | B2 | 1/2005 | Salice | |
| 7,065,833 | B2 | 6/2006 | Kropf | |
| 7,275,284 | B2 * | 10/2007 | Lautenschlager et al. | 16/287 |
| 7,328,484 | B2 * | 2/2008 | Salice | 16/354 |
| 7,395,580 | B2 * | 7/2008 | Brustle et al. | 16/50 |
| 7,552,509 | B2 * | 6/2009 | Chen et al. | 16/50 |
| 7,730,583 | B2 * | 6/2010 | Salice | 16/286 |
| 7,874,043 | B2 * | 1/2011 | Salice | 16/286 |
| 7,917,995 | B2 * | 4/2011 | Salice | 16/288 |
| 2003/0200625 | A1 | 10/2003 | Zimmer | |
| 2006/0026792 | A1 * | 2/2006 | Brustle et al. | 16/54 |
| 2007/0136990 | A1 * | 6/2007 | Salice | 16/282 |

OTHER PUBLICATIONS

European Search Report, European Patent Application No. 09704540.5, dated Sep. 19, 2012 (6 pages).

Chinese Office Action (With English Translation), Chinese Application No. 2009801034074, dated May 20, 2013 (22 pages).

* cited by examiner

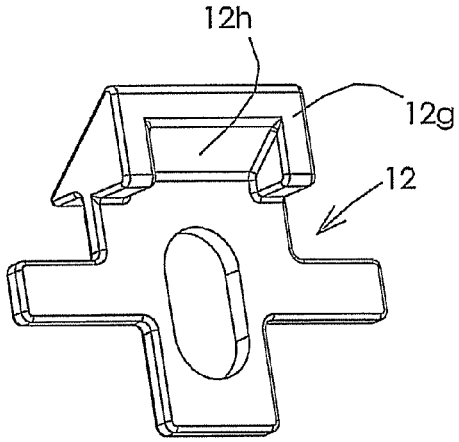
Fig. 5a
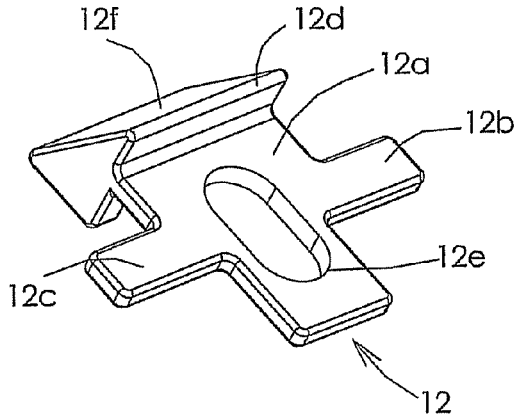
Fig. 5b
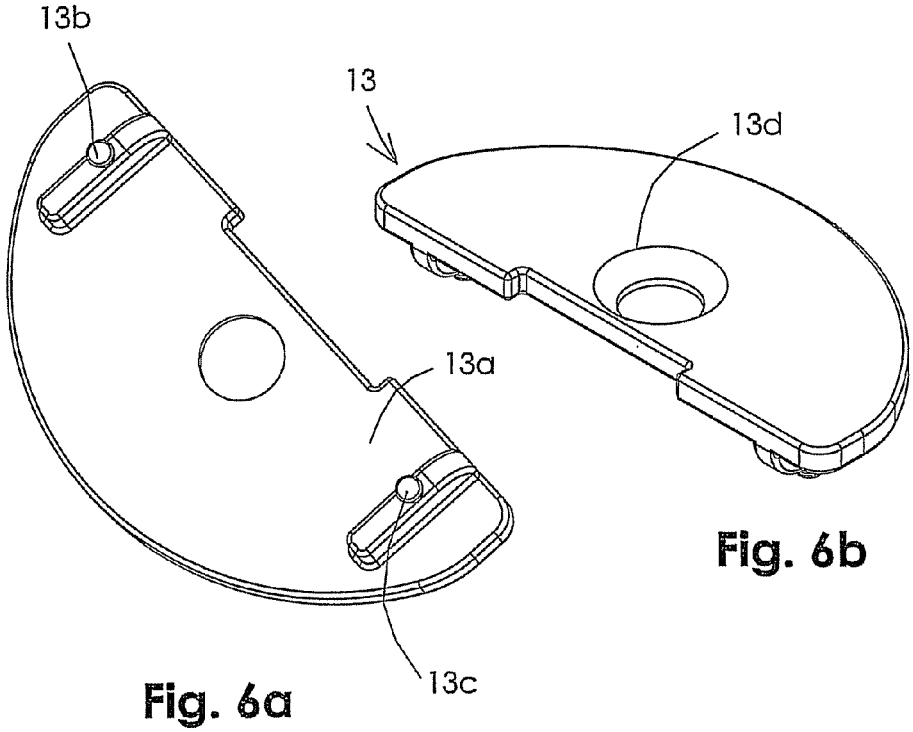
Fig. 6b
Fig. 6a

Scale: 8:1

Scale: 20:1

DAMPING MECHANISM FOR CABINET HINGE ASSEMBLY

CROSS-REFERENCE TO RELATED APPLICATIONS

This application is based upon and claims the benefit of priority from U.S. Provisional Application Ser. No. 61/022,585 filed Jan. 22, 2008, U.S. Provisional Application Ser. No. 61/049,084 filed Apr. 30, 2008, and U.S. Provisional Application Ser. No. 61/060,167 filed Jun. 10, 2008, all of the contents of which is incorporated herein by reference.

FIELD OF THE INVENTION

The present invention relates generally to hinge devices for mounting a door on a furniture article, and more particularly to adjustable hinge devices for hanging doors on cabinets or the like. The hinge devices include a damping mechanism for preventing "door slap" when the cabinet doors are closed.

BACKGROUND OF THE INVENTION

The technology associated with adjustable hinges that are used in cabinets, such as kitchen cabinets, has progressed significantly over the last twenty years. Great strides have been taken to improve such hinge assemblies so as to allow adjustment for different types of cabinets, different hinge placements (e.g., external and internal), and different styles of hinge attachment (e.g., recessed). One type of cabinet hinge assembly includes a cabinet fixation section that is attached to the cabinet housing and a hinge cup that is recessed in the cabinet door. Examples of these types of hinge assemblies can be found in U.S. Pat. Nos. 6,996,877, 7,117,561 and 7,231,691, all of which are incorporated herein by reference.

While most hinge cup type cabinet assemblies include a spring mechanism to bias movement of the cabinet door while opening and closing, those spring mechanisms cannot prevent "door slap" that occurs when the cabinet doors make abrupt contact with the cabinet housing upon closing. Such "door slap" makes the cabinets not only noisy, but prone to damage over time.

SUMMARY OF THE INVENTION

A hinge assembly for mounting a door to a housing comprising a fixation section, a hinge cup pivotally connected to the housing fixation section, and a damping mechanism positioned entirely within the hinge cup (which makes it ideal for retro-fit applications) to dampen movement of the door as it closes on the housing. The hinge assembly can be used in both frame hinge and frameless hinge applications. In this embodiment, the damping mechanism of the hinge assembly comprises a slider that is movably coupled within the hinge cup. The damping mechanism further comprises a biasing member to urge the slider from a first position in the hinge cup to a second position in the hinge cup when the door is opened.

The hinge assembly further comprises a mechanism for adjusting the initial position of the slider with respect to the hinge cup. In one embodiment, the mechanism for adjusting the initial position of the slider is a cam rivet that is press fit within the hinge cup but can be rotated to an extent by an integral cam screw. The damping mechanism also further comprises a cover that includes a hole that allows access to the cam screw.

In another embodiment, the hinge assembly for mounting a door to a housing comprises a housing fixation section, a hinge cup pivotally connected to the housing fixation section, and a damping mechanism (positioned entirely within the hinge cup) to dampen movement of the door as it closes on the housing. The damping mechanism comprises a slider, a biasing member, a damper and a cover, wherein the slider is movably coupled within the hinge cup, the biasing member urges the slider in a first direction within the hinge cup, the damper dampens movement of the slider in a second direction, opposite the first direction, within the hinge cup, and the cover holds the slider, damper and biasing member within the hinge cup. In one embodiment, the biasing member is a spring. The hinge assembly can be used in both frame hinge and frameless hinge applications.

The hinge assembly further comprising a mechanism for adjusting the initial position of the slider with respect to the hinge cup, and thus control a damping force exhibited by the damper. In one embodiment, the mechanism for adjusting the initial position of the slider is a cam rivet that is press fit within the hinge cup but can be rotated to an extent by an integral cam screw. The hinge assembly further comprising a cover that includes a slow that allows access to the cam screw.

A hinge assembly for mounting a door to a housing comprising a housing fixation section, a hinge cup pivotally connected to the housing fixation section, and a damping mechanism (positioned entirely within the hinge cup) to dampen movement of the door as it closes on the housing. The damping mechanism comprising a cover, a slider housing movably coupled to the cover, a biasing member, and a piston assembly positioned within the slider housing, wherein the biasing member urges the slider housing in a first direction within the hinge cup, and the piston assembly dampens movement of the slider housing in a second direction, opposite the first direction, within the hinge cup. The hinge assembly can be used in both frame hinge and frameless hinge applications.

In one embodiment of the hinge assembly, the slider housing comprises at least one slide groove on an upper surface thereof that is complimentary in shape to at least one slider housing guide on a lower surface of the cover to limit the direction of movement of the slider housing with respect to the cover to a single axial direction. The slider housing further comprises at least one flange part on a side surface thereof that cooperates with the biasing member to urge the slider housing in the first direction within the hinge cup.

The piston assembly further comprising a piston rod, a shaft seal, a piston and a piston seal. In one embodiment, the piston and piston seal are fixedly attached to the cover via the piston rod. The hinge assembly further comprises a damping fluid within the slider housing wherein the piston includes orifices extending therethrough to allow the damping fluid to move between opposite ends of an interior of the slider housing as the slider housing moves relative to the hinge assembly.

BRIEF DESCRIPTION OF THE DRAWINGS

FIGS. 5*a* and 5*b* are bottom and top perspective views of the slider component of the damping mechanism shown in FIG. 2;

FIGS. 6*a* and 6*b* are bottom and top perspective views of the cover component of the damping mechanism shown in FIG. 2;

DETAILED DESCRIPTION OF THE INVENTION

Figure 1:
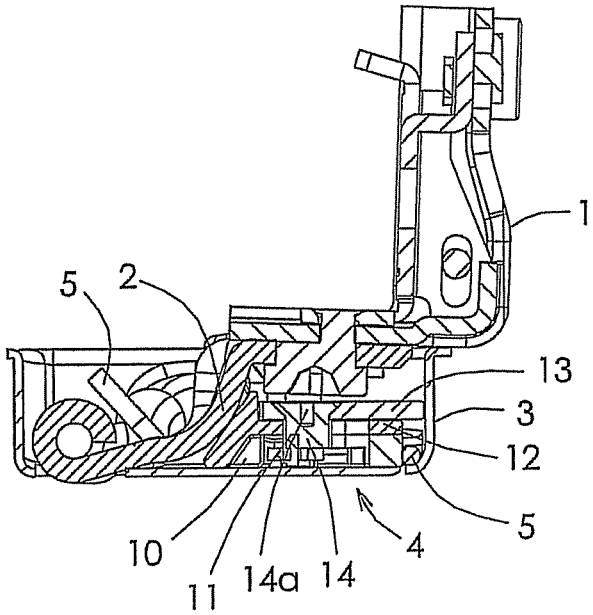
FIG. 1 is a cross-sectional view of a hinge assembly having a damping mechanism according to one embodiment of the present invention.

FIG. 1 shows a hinge assembly having a damping mechanism according to one embodiment of the present invention. The hinge assembly includes a cabinet fixation section 1 and a hinge cup 3. Positioned within the hinge cup 3 is a damping mechanism 4 that interacts with the band arm 2 of the cabinet fixation section 1 so as to dampen movement of the cabinet door as it closes on the cabinet housing.

The damping mechanism 4 (shown in cross-section in FIG. 1) includes an adjustment plate 11, a damper 10, a slider 12, and a cover 13, stacked in this order from the bottom of the hinge cup 3. A cam rivet 14 extends through damper 10, adjustment plate 11 and slider 12 to help hold those parts in place within hinge cup 3 and to allow controlled movement of adjustment plate 11 and damper 10, while allowing free movement of slider 12, as will be explained in more detail below.

Figure 2:
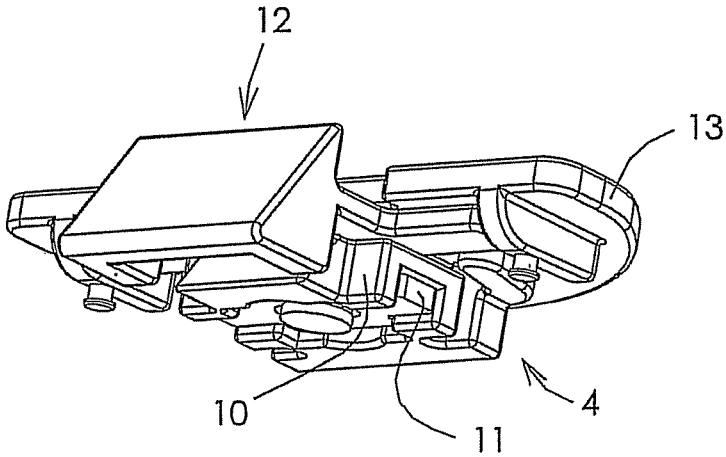
FIG. 2 is a bottom perspective view of the damping mechanism shown in FIG. 1.

FIG. 2 is a bottom perspective view of the damping mechanism 4, and FIGS. 3-6 respectively show damper 10, adjustment plate 11, slider 12 and cover 13.

Figure 3A:
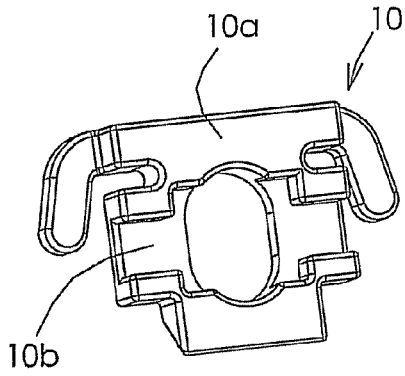
FIGS. 3*a* and 3*b* are bottom and top perspective views of the damper component of the damping mechanism shown in FIG. 2.
Figure 3B:
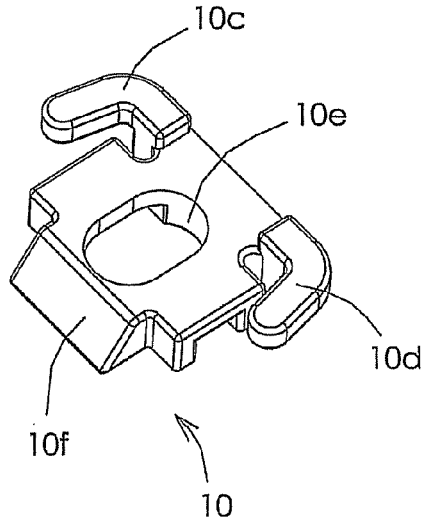

FIGS. 3*a* and 3*b* show the structure of damper 10, which includes a base 10*a* having a bottom recess 10*b* for receiving adjustment plate 11. Extending from a top surface of base 10*a* are two resilient spring arms 10*c* and 10*d*, respectively. Damper 10 also includes an elongated slot 10*e* passing through the entire thickness of base 10*a*. The slot 10*e* cooperates with cam rivet 14 to allow controlled movement of damper 10 relative to hinge cup 3, as will be explained in more detail below. An angled face 10*f* of damper 10 cooperates with a notched area 12*h* in the rear face of slider angled face 12*f* (see FIG. 5*a*).

Damper 10 can be made of any material that will provide the desired spring tension in resilient spring arms 10*c* and 10*d*. A variety of plastics are suitable, and include thermoplastic and elastomeric types, for example. Alternately, Damper 10 can be made of steel, beryllium copper or other resilient metals and metal alloys.

Figure 4:
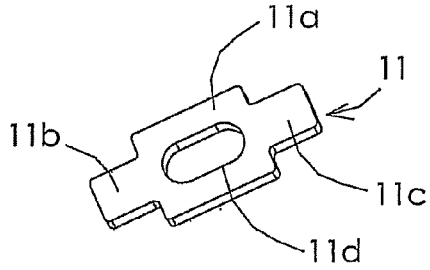
FIG. 4 is a perspective view of the adjustment plate component of the damping mechanism shown in FIG. 2.

FIG. 4 shows the structure of adjustment plate 11, which includes a base 11*a* having two tabs 11*b* and 11*c* extending laterally from the sides of base 11*a*. Adjustment plate 11 also includes an elongate slot 11*d* which traverses the width thereof and cooperates with cam rivet 14 to allow movement of the adjustment plate 11. The adjustment plate 11 fits within the correspondingly shaped recess 10*b* in damper 10 such that movement of adjustment plate 11 will cause corresponding movement of damper 10, as will be explained in more detail below.

Adjustment plate 11 can be made of any material that will cooperate with the cam rivet 14 to allow movement of adjustment plate 11 without undue friction. A variety of plastics and hard metals, such as steel, are suitable.

FIGS. 5*a* and 5*b* show the structure of slider 12, which includes a base 12*a* having two tabs 12*b* and 12*c* extending laterally from the sides of base 12*a*. An inclined part 12*d* is formed at the forward end of base 12*a* and extends upwardly therefrom. Inclined part 12*d* includes an angled face 12*f* that forms an approximately triangular shaped portion extending from base 12*a*. The lower face 12*g* of the triangular shaped portion is parallel to base 12*a* and helps define notched area 12*h* on the face opposite angled face 12*f*. The notched area 12*h* is shaped to accommodate the angled face 10*f* of damper 10. A slot 12*e* extends through the entire thickness of base 12*a*. The slot 12*e* cooperates with cam rivet 14 to allow free movement of slider 12 relative to hinge cup 3, which will also be explained in more detail below.

Slider 12 can be made of any material that can withstand the forces exerted thereon by band arm 2 of cabinet fixation section 1. A variety of plastics are suitable, and include thermoplastic and thermoset types, for example.

FIGS. 6*a* and 6*b* show the structure of cover 13, which includes a base 13*a* and two rivets 13*b* and 13*c* extending from a bottom surface of base 13*a*. The cover 13 prevents slider 12 from becoming separated from the cam rivet 14, and also shields the mechanical parts from view when the hinge assembly is installed in a hinge cup. Rivets 13*b* and 13*c* extend through and are held against the bottom of hinge cup 3. Cover 13 also includes a recessed hole 13*d* for housing the screw head 14*a* of cam rivet 14, which will be explained in greater detail below.

Cover 13 can be made of any material that will allow the rivets 13*b* and 13*c* to be easily deformed and held against the bottom of hinge cup 3. A variety of hard plastics and metals, such as steels, are suitable.

The cam rivet 14 includes a screw portion 14*a* that is accessible is the recessed hole 13*d* of cover 13. Cam rivet 14 includes a base 14*b* (see FIG. 9) that is press fixed within hinge cup 3 to such an extent that the cam rivet can be rotated through actuation of the screw portion 14*a*, but will resist any further rotation due to other external forces that may be exerted thereon during use by the other components of the damping mechanism 4. A cam portion 14*c* (see FIG. 9) of cam rivet 14 cooperates with the slot 11*d* in adjustment plate 11 so that the adjustment plate 11 moves left or right in FIG. 1 when the screw portion 14*a* is rotated. This movement causes a corresponding movement of damper 10 to adjust the damping effect thereof on slider 12, as will be explained in more detail below.

Figure 7:
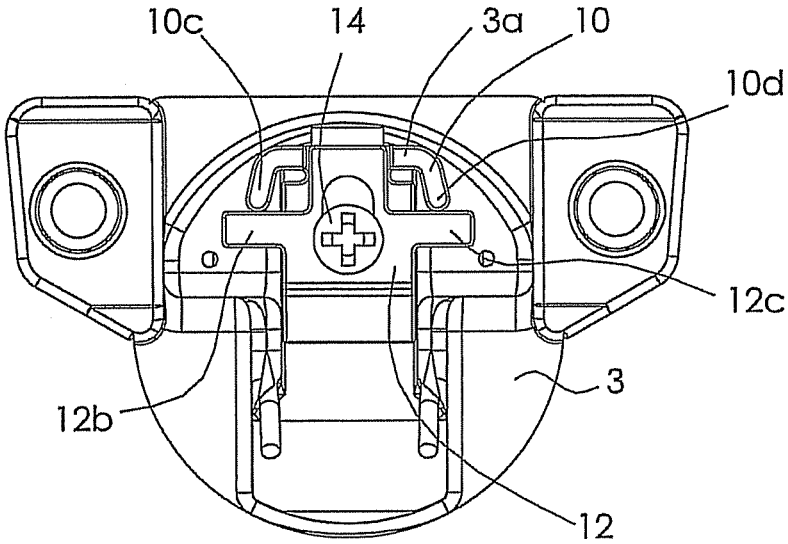
FIG. 7 is a top view of the hinge assembly shown in FIG. 1 with the cover component of the damping mechanism removed.

As the hinge assembly of FIG. 1 is closed to within about 15° of the closed position, slider 12 is in a position to the left relative to its position shown in FIG. 1, due to the resilient spring arms 10*c* and 10*d* of damper 10 pushing against the tabs 12*b* and 12*c* of slider 12. As the band arm 2 of the cabinet fixation section 1 comes into contact with the angled face 12*f* of slider 12, this contact will force the slider to move to the right in FIG. 1. The contact between tabs 12*b* and 12*c* of slider 12 and resilient spring arms 10*c* and 10*d* of damper 10, combined with the resilient nature of the spring arms, dampens the movement of band arm 2, and thus prevents "door slap" when the cabinet door closes. The contact between tabs 12*b* and 12*c* and spring arms 10*c* and 10*d* is shown more clearly in FIG. 7.

It can be appreciated that cabinet doors come in a variety of sizes and are made of a variety of materials. Consequently, the force created when those doors are closed varies as the size and materials of the doors vary. As such, smaller doors made of a given material will require a softer damping effect than larger doors made of the same material, for example.

In order to accommodate these required variations in damping effect, the cam rivet 14 includes the cam portion 14*c* discussed above. Again, cam portion 14*c* cooperates with the elongate slot 11*d* formed through the base 11*a* of adjustment plate 11 to allow damper 10 to be moved longitudinally within a slot 3*a* (see FIG. 8) formed in the bottom surface of hinge cup 3. This allows the otherwise fixed spring constant associated with resilient spring arms 10*c* and 10*d* of damper 10 to exhibit a variety of damping forces against slider 12 simply by effectively controlling the position of damper 10 and slider 12 relative to the band arm 2 of cabinet fixation section 1. For example, if a stiffer damping effect is required, the cam screw portion 14*a* could be rotated to adjust the rotational orientation of cam portions 14*c* to move adjustment plate 11, and thus damper 10 within slot 3*a* of hinge cup 3 towards the center of the hinge cup, which would effectively produce a longer stroke in the movement of slider 12 once it comes into contact with band arm 2. If a softer damping effect is desired, the cam screw portion 14*a* could be rotated in the opposite direction to move the damper 10 within slot 3*a* away from the center of hinge cup 3, which would effectively decrease the stroke of movement of slider 12 when it comes into contact with band arm 2. By changing the stroke length of slider 12, one can accomplish a variety of damping effects while still using a damper of fixed spring constant.

The cover 13, shown in FIG. 6, essentially shields the component parts of damping mechanism 4 from view once the hinge assembly is installed. The hole 13*d* in cover 13 allows easy access to the cam screw portion 14*a* for easy adjustment of the tension of the damping mechanism 4.

Figure 8:
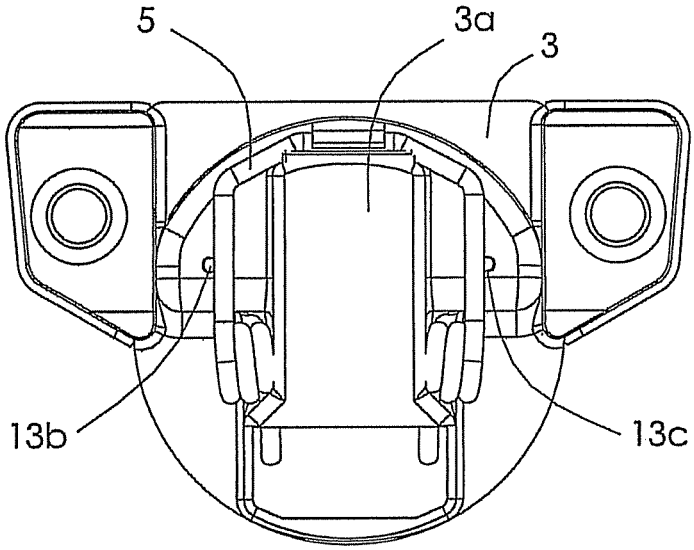
FIG. 8 is a bottom view of the hinge assembly shown in FIG. 1.

FIG. 8 is a bottom view of hinge cup 3, and shows the position of the rivets 13*b*, 13*c* of cover 13, as well as main spring 5 that biases the band arm during opening and closing of the cabinet door.

One of the primary benefits of the damping mechanism 4, shown in FIGS. 1-8, is that all of the components of the damping mechanism are contained within the hinge cup. This requires minimal modifications to existing hinge cup designs and also allows the damping function to be implemented as soon as the hinge assembly is in position (as opposed to having a separate damper assembly that would require separate installation on the cabinet).

Figure 9:
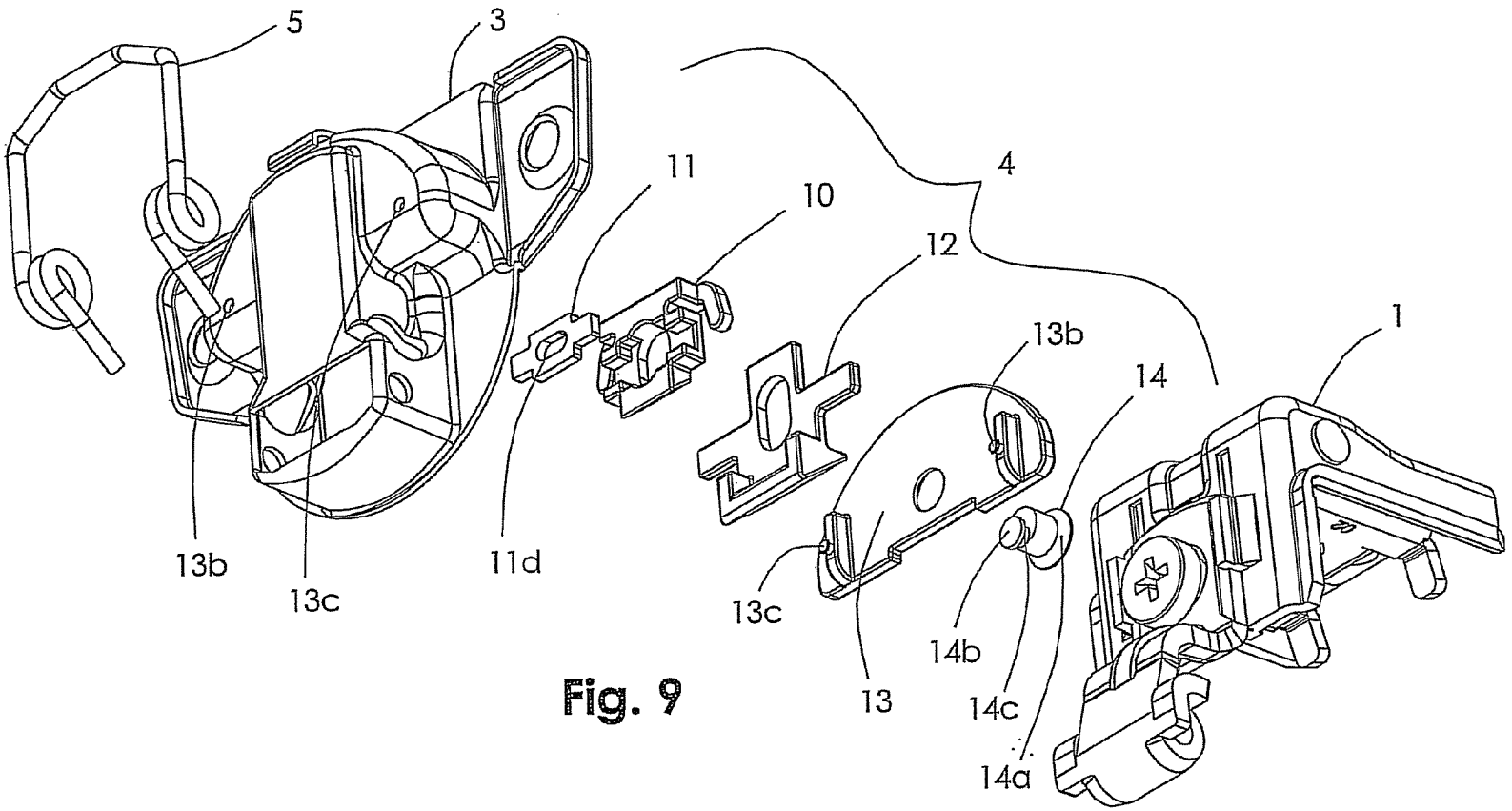
FIG. 9 is an exploded perspective view of the hinge assembly shown in FIG. 1.

FIG. 9 shows the component parts of FIGS. 1-8 in an exploded view. The rivet 14 is rotatably fixed within cover 13 and the base 14*b* rides on the bottom surface of adjustment plate 11. In this manner, rivet 14 holds all of the component parts of damping mechanism 4 as a sub-assembly before the damping mechanism 4 is snap fit within hinge cup 3. In this regard, there are complementary recesses formed within hinge cup 3 that will accept the outer profile of cover 13 so that the sub-assembly can be snapped into place within hinge cup 3.

Figure 10:
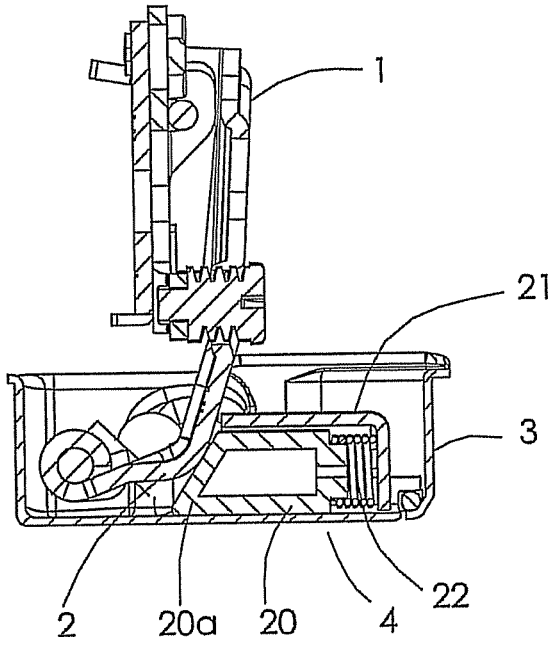
FIG. 10 is a cross-sectional view of a hinge assembly having a damping mechanism according to a another embodiment of the present invention.

FIG. 10 is a cross-sectional view of a hinge assembly having a damping mechanism in accordance with another embodiment of the present invention. This hinge assembly also includes a cabinet fixation section 1 (having a band arm 2), a hinge cup 3 and a damping mechanism 4 that is entirely contained within the hinge cup.

The damping mechanism 4 in this embodiment takes the form of a mini shock absorber positioned within a housing 21. The mini shock absorber includes a plunger 20 and a spring 22 that biases the plunger 20 out of the housing as the cabinet door is opened and the band arm 2 moves away from an inclined surface 20*a* of plunger 20. A suitable damping fluid (e.g., oil) is contained within the mini shock absorber and provides the desired damping effect when the band arm 2 contacts the inclined surface 20*a* of plunger 20 as the cabinet door is closing.

Figure 11:
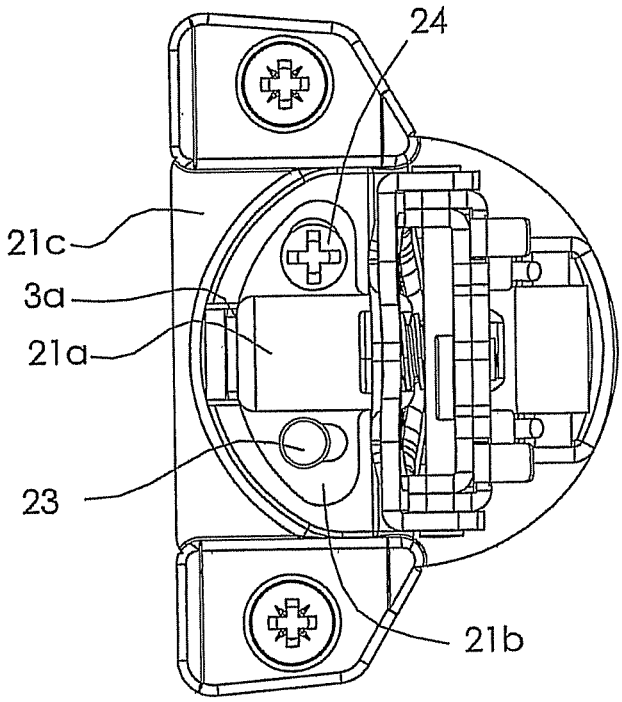
FIG. 11 is a top perspective view of the hinge assembly shown in FIG. 10.

FIG. 11 is a top perspective view of the hinge assembly shown in FIG. 10. FIG. 11 shows that the housing 21 includes a semi-cylindrical portion 21*a* and two flange portions 21*b* and 21*c* extending therefrom. The semi-cylindrical portion 21*a* holds the mini shock absorber in position within hinge cup 3. Each of the flange members 21*b* and 21*c* includes a slot passing therethrough that cooperates with a rivet 23 and a cam mechanism 24, both of which are fixed to the bottom of hinge cup 3. The cam mechanism 24 is essentially the same as the cam mechanism in the embodiment shown in FIGS. 1-9 in that, when the cam screw is rotated, the entire housing 21, and thus the mini shock absorber, can be moved toward or away from the center of hinge cup 3. This movement will affect the amount of damping provided when band arm 2 contacts inclined surface 20*a* of plunger 20.

FIG. 11 shows that hinge cup 3 includes a slot 3*a* in which the mini shock absorber can move in a linear fashion when the cam mechanism is rotated. By constraining the mini shock absorber to slot 3*a*, the housing 21, and thus the mini shock absorber, is forced to move in a linear manner, constrained only by the interaction of the slots in the flange members 21*b* and 21*c* with the rivet 23 and cam mechanism 24, respectively.

Figure 12:
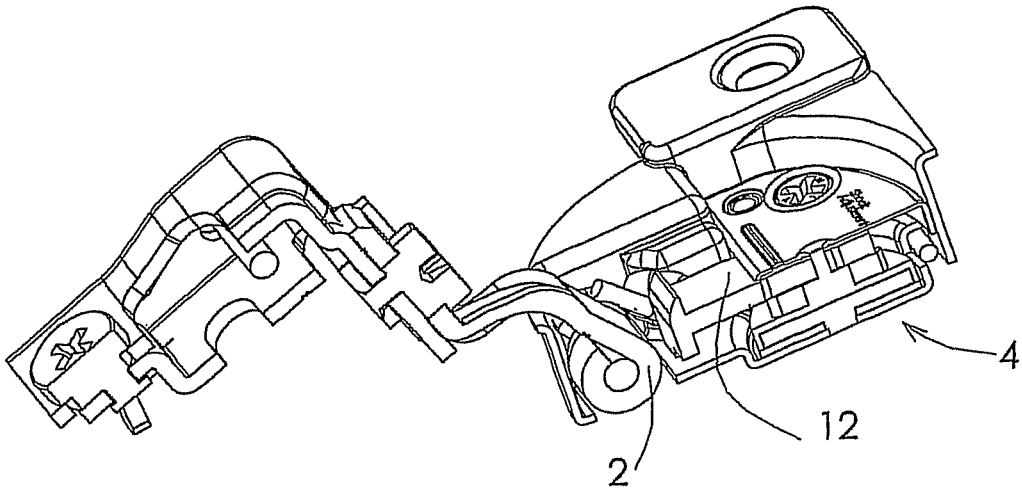
FIG. 12 is a cross-sectional view of a hinge assembly having a damping mechanism according to another embodiment of the present invention.

FIG. 12 is a cross-sectional view of a hinge assembly having a damping mechanism in accordance with another embodiment of the present invention. This hinge assembly also includes a cabinet fixation section 1 (having a band arm 2), a hinge cup 3 and a damping mechanism 4 that is entirely contained within the hinge cup.

Figure 13:
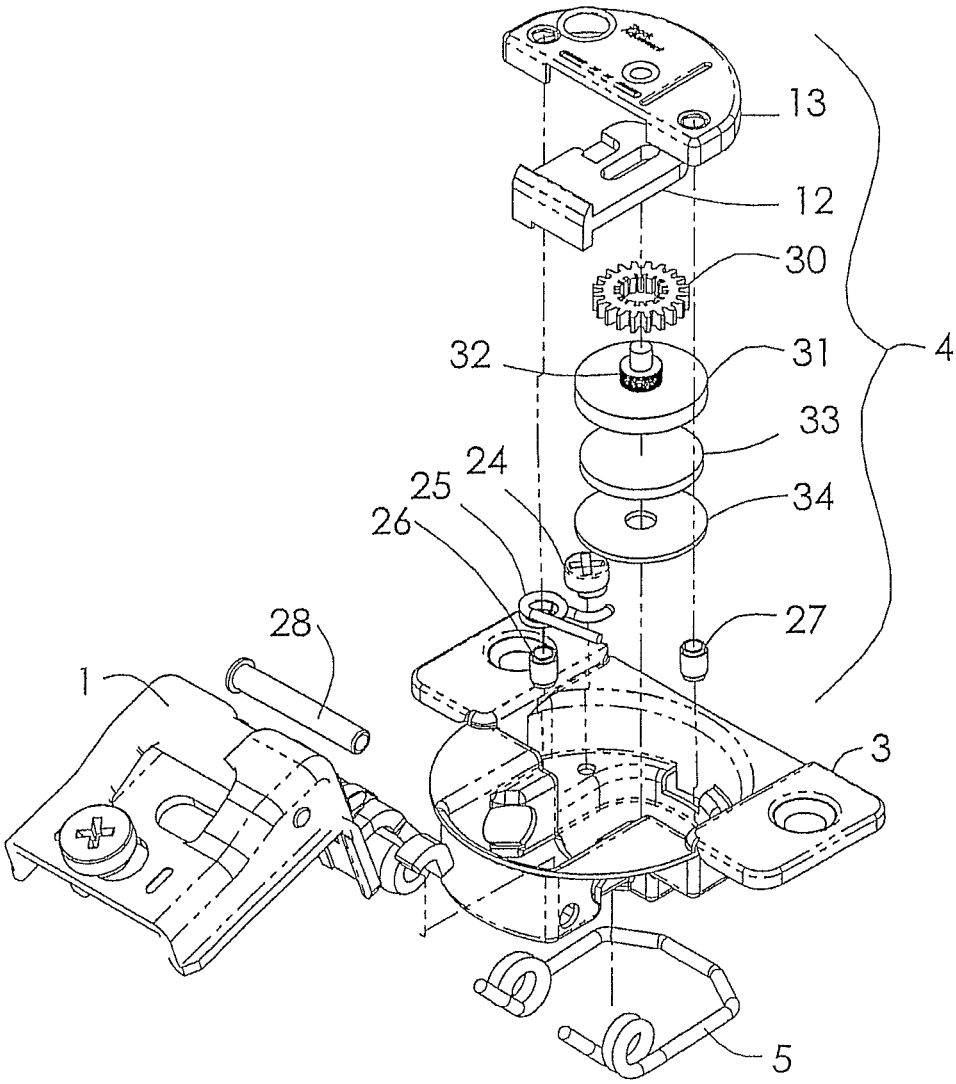
FIG. 13 is a top exploded perspective view of the hinge assembly shown in FIG. 12.
Figure 14:
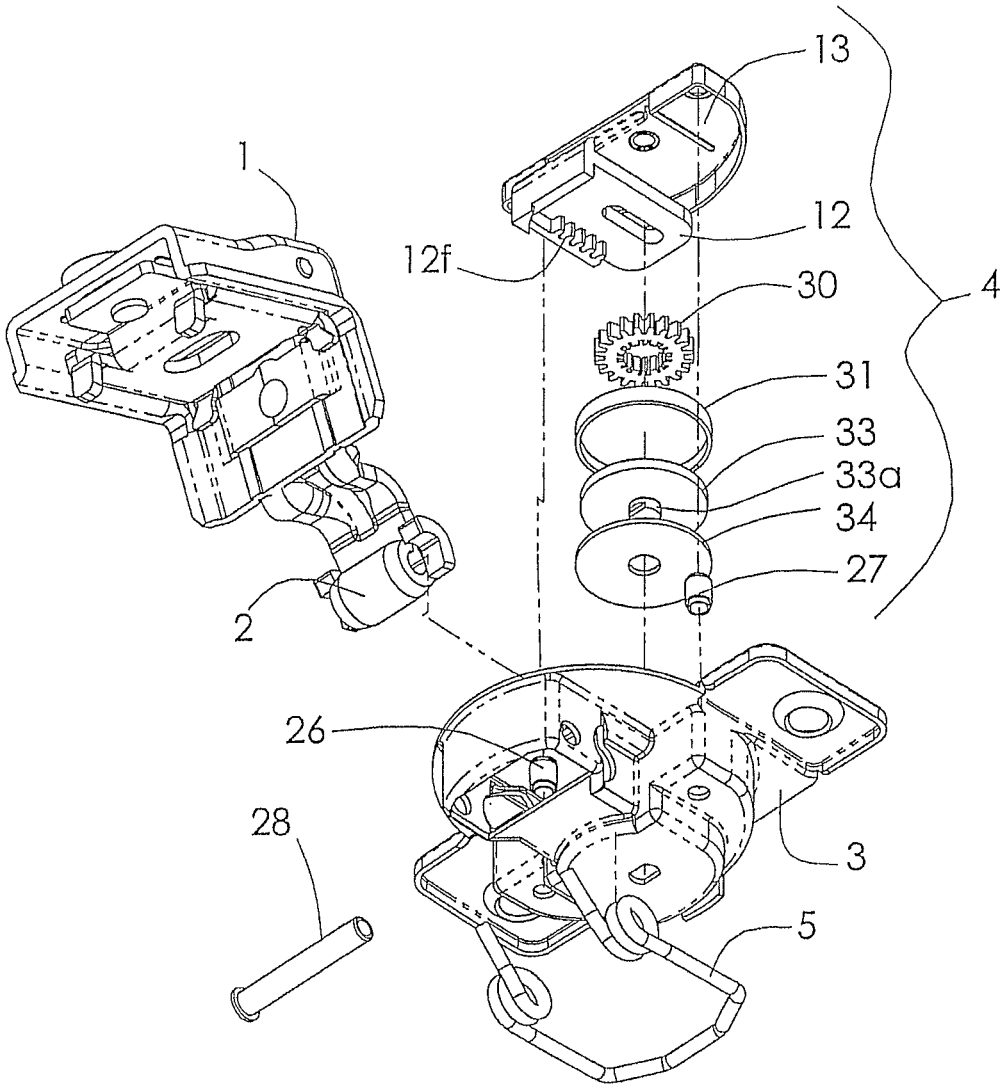
FIG. 14 is a bottom exploded perspective view of the hinge assembly shown in FIG. 12.

FIGS. 13 and 14 are top and bottom exploded perspective views showing the components of the damping mechanism 4 of FIG. 12. The damping mechanism 4 is essentially a rotary damper, and as such, any known rotary damper could be used in this embodiment. In the specific embodiment depicted in FIGS. 12-14, the rotary damper includes a gear 30 that rides on shaft 32 of rotary damper housing 31. The internal portion of gear 30 and the external portion of shaft 32 include splines that allow the gear to rotate freely in one direction, but engage the shaft 32 of rotary damper housing 31 when rotated in the opposite direction. A stationary damping disk 33 includes a shaft 33*a* that extends through a damper cover 34 and is fixed to the bottom of hinge cup 3. Grease is positioned within the rotary damper so as to provide dampened rotation of the rotary damper housing 31 with respect to stationary damping disk 33.

FIG. 14 shows that slider 12 includes a gear rack 12*f* that engages the teeth of gear 30. The splines (discussed above) will allow the slider 12 to move freely in one direction, but move in a dampened fashion in the opposite direction.

Referring back to FIG. 13, a spring 25 is held within hinge cup 3 on a rivet 26 and functions to bias slider 12 towards band arm 2 as the cabinet door is opened. The tension of spring 25 can be adjusted by adjustment screw 24 to increase the damping effect of the rotary damper when necessary to accommodate heavier loads (e.g., bigger cabinet doors).

The hinge assembly shown in FIG. 13 includes a cover 13 that is in position to shield and hold the components of the damping mechanism 4 from view during use. The cover 13 is fixed to hinge cup 3 by rivet 26. Preferably, the cover 13 is fixed to hinge cup 3 by rivets 26 and 27, as shown in FIG. 13. The cabinet hinge assembly also includes hinge pin 28 which connects main spring 5 to band arm 2 of cabinet fixation section 1, as shown in FIGS. 13 and 14.

Figure 15:
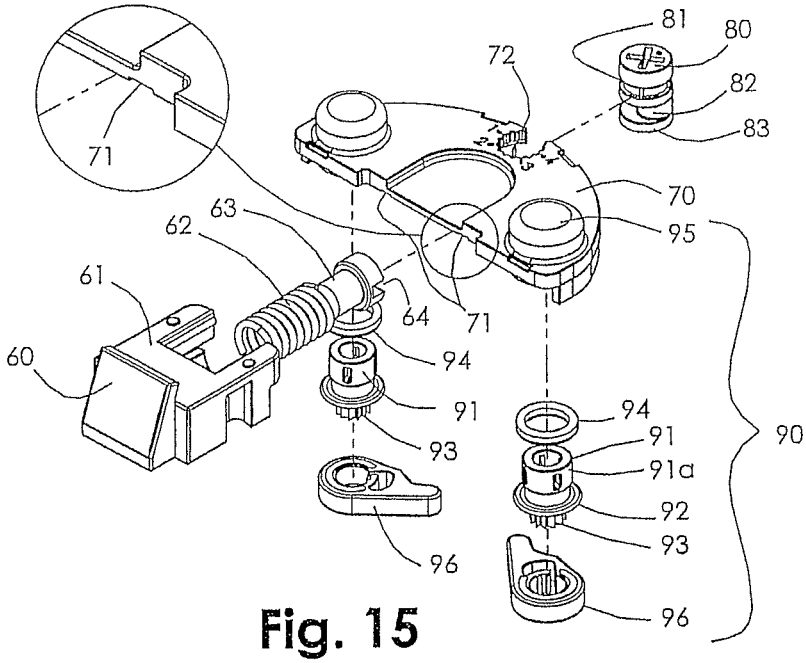
FIG. 15 is a top exploded perspective view of a damping mechanism in accordance with another embodiment of the present invention.
Figure 16:
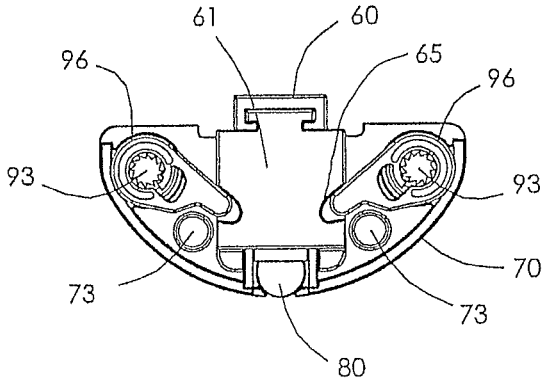
FIG. 16 is a bottom view of the damping mechanism of FIG. 15.
Figure 17:
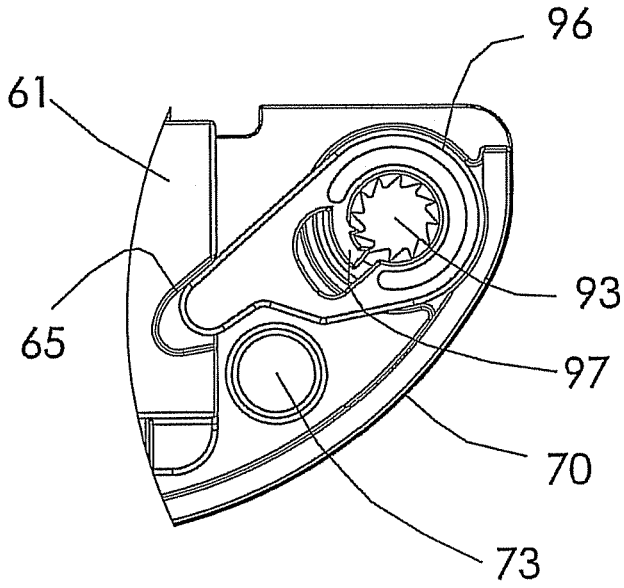
FIG. 17 is a partial view of the damper structure shown in FIGS. 15 and 16.

FIGS. 15-17 show a damping mechanism according to another embodiment of the present invention. The damping mechanism includes a slider 60 that is mounted on the front end of a spring housing 61 by a T-head/T-slot joint (see FIG. 16). A spring 62 is positioned within spring housing 61 and the damping mechanism is entirely contained within the hinge cup. A spring plug/cam follower 63 is inserted into an exposed end of spring 62. The rear end of spring plug/cam follower 63 includes a slot 64 that cooperates with cam 80, as will be described below.

The damping mechanism includes a cover 70, much like the other embodiments described above. The cover 70 is dimensioned so as to snap into the hinge cup 3 in a fixed manner. The cover 70 includes a recess 72 for receiving cam 80, as will be described below.

In the present embodiment, the cover 70 includes a groove 71 in the lower surface thereof in which the spring housing 61 moves to ensure that slider 60 moves in a substantially linear manner relative to the hinge cup 3. As explained above in connection with the other embodiments, the hinge cup 3 also includes a slot 3*a* in which spring housing 61 moves to ensure substantially linear movement of the slider 60 relative to the hinge cup 3.

Cam 80 includes an annular groove 81 that is dimensioned so as to snap-fit within recess 72 of cover 70. The annular groove includes outwardly extending protrusions that engage corresponding slots within recess 72 so that when cam 70 is rotated to a given position, it will remain in that position until rotated again to change the axial position of spring plug/cam follower 63. More specifically, cam 80 includes a disc portion 83 that rides within groove 64 formed on the rear end of spring plug/cam follower 63. Cam 80 also includes a cam surface 82 that engages the rear end of spring plug/cam follower 63 to change the axial position thereof, and thus change the biasing force exerted by spring 62 on spring housing 61, and thus slider 60. As explained earlier in connection with other embodiments of the present invention, the tension of the slider can be adjusted by rotating cam 80 to one of four selected positions in the case of the embodiment shown in FIG. 15.

The damping mechanism also includes a damper 90 that controls the return stroke of the slider when the associated cabinet door is closed. The damper 90 includes a cylindrical damper post 91 having an outwardly extending flange 92 and ratchet teeth 93 formed on the lower end thereof. The upper end of damper post 91 is rotatably fixed within a damper housing 95 formed in cover 70. The damper housing 95 includes a fluid, a grease material, or air that provides a desired resistance to rotation of the damper post 91 relative to damper housing 95. As such, an o-ring seal 94 is positioned between flange 92 and the opening of damper housing 95. A plurality of slots 91*a* are formed through the wall of damper post 91 so that the fluid or grease material can access the interior and exterior of damper post 91 within damper housing 95.

Damper 90 also includes a damper arm 96 that has an internal ratchet arm 97 with teeth that engage ratchet teeth 93 on the lower portion of damper post 91 (see FIG. 17). The damper arm 96 engages a notch 65 in the lower surface of spring housing 61 (see FIG. 16).

As the associated cabinet door is opened, the spring 62 forces spring housing 61, and thus slider 60, in a direction away from the cover 70. This in turn causes damper arm 96 to rotate towards the top of the page in FIG. 17. The orientation of the ratchet teeth as shown in FIG. 17 is such that the teeth will not impede this particular movement of the damper arm 96. However, when the associated cabinet door is closed, the damper arm 96 rotates in the opposite direction so that the ratchet teeth on internal ratchet arm 97 and the ratchet teeth 93 on the lower portion of damper post 91 engage one another, and thus cause damper post 91 to rotate within damper housing 95. Again, the presence of the damping fluid or grease within damper housing 95 will impede the rotation of damper post 91, and thus dampen the force that the cabinet door exerts on the damping mechanism as a whole.

FIGS. 16 and 17 also show that cover 70 includes a stop member 73 positioned near each damper arm 96. These stop members are designed to control the extent to which cover 70 is snapped into hinge cup 3 to prevent over-compression of the damper mechanism, and thus ensure that the damper posts 91 and damper arms 96 can move freely within hinge cup 3.

FIGS. 18-21 show a damping mechanism according to another embodiment of the present invention. Like the embodiment shown in FIGS. 15-17, the damping mechanism according to this embodiment also includes a slider 100 that is mounted on the front end of spring housing 101 by a T-head/T-slot joint and the damping mechanism is entirely contained within the hinge cup. A spring 102 is positioned within spring housing 101, and a spring plug/cam follower 103 is inserted into an exposed end of spring 102. The rear end of spring-plug/cam follower 103 includes a slot 104 that cooperates with a cam 105 in the same manner as described above in connection with FIGS. 15-17.

Figure 18:
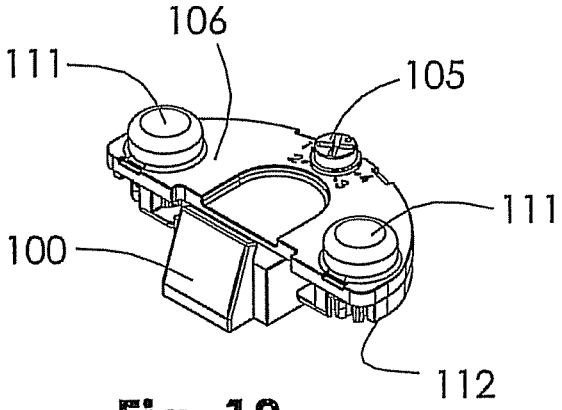
FIG. 18 is a top perspective view of a damping mechanism in accordance with another embodiment of the present invention.

The damping mechanism shown in FIG. 18 includes a combined cover/housing 106, which, like the other embodiments described above, is dimensioned so as to snap into the hinge cup 3 in a fixed manner. The cover 106 includes a recess 107 for receiving the cam 105 in the same manner as described above in connection with FIGS. 15-17. The cam 105 interacts with the spring plug/cam follower 103 to change the axial position of the slider 100 in the same manner as described earlier herein.

Figure 19:
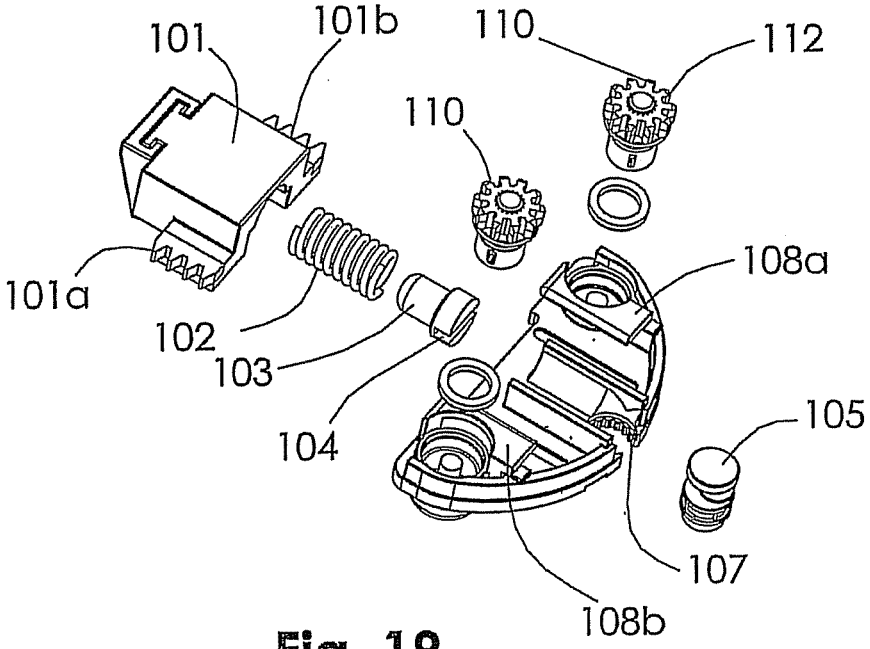
FIG. 19 is a bottom exploded perspective view of the damping mechanism shown in FIG. 18.

The spring housing 101 includes laterally extending linear gear parts 101*a*, 101*b* that ride within channels 108*a*, 108*b* formed in the cover/housing 106 as shown in FIG. 19. The bottom surface of spring housing 101 moves within slot 3*a* in hinge cup 3 in the same manner as described above in connection with the other embodiments.

A pair of dampers 110 are rotatably fixed within a pair of damper housings 111 formed in cover/housing 106, and include gear members 112 that cooperate with the gears parts 101*a*, 101*b* to control the return stroke of slider housing 101, and thus slider 100, much in the same manner as described above with respect to FIGS. 15-17.

Figure 20:
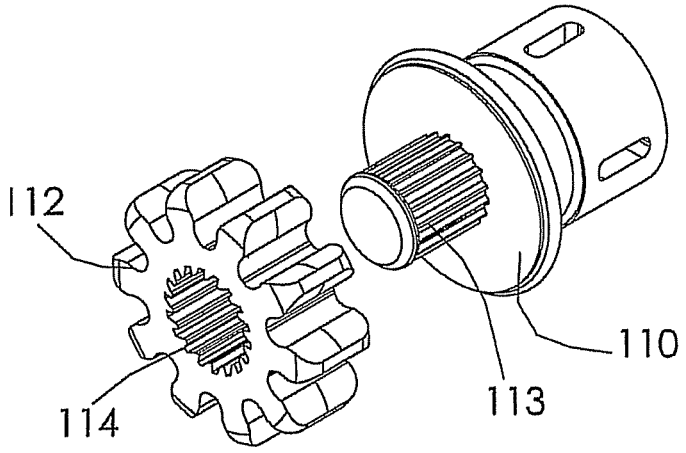
FIG. 20 is an exploded view of the damper shown in FIG. 19.
Figure 21:
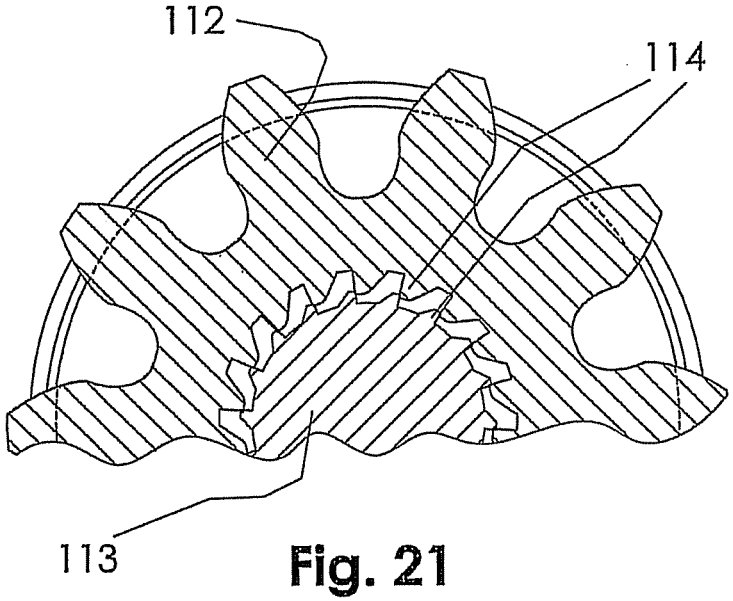
FIG. 21 is an enlarged view of a portion of FIG. 20.

FIG. 20 shows that each damper 110 includes a damper post 113 having longitudinally extending ribs formed on the outer surface thereof. Those ribs interact with ratchet teeth 114 formed on the interior surface of gear 112 to provide the same type of one-way resistance described above with respect to damper arms 96 shown in FIGS. 15-17. FIG. 21 shows the interaction between these ribs and ratchet teeth to provide one-way resistance to movement.

Figure 22:
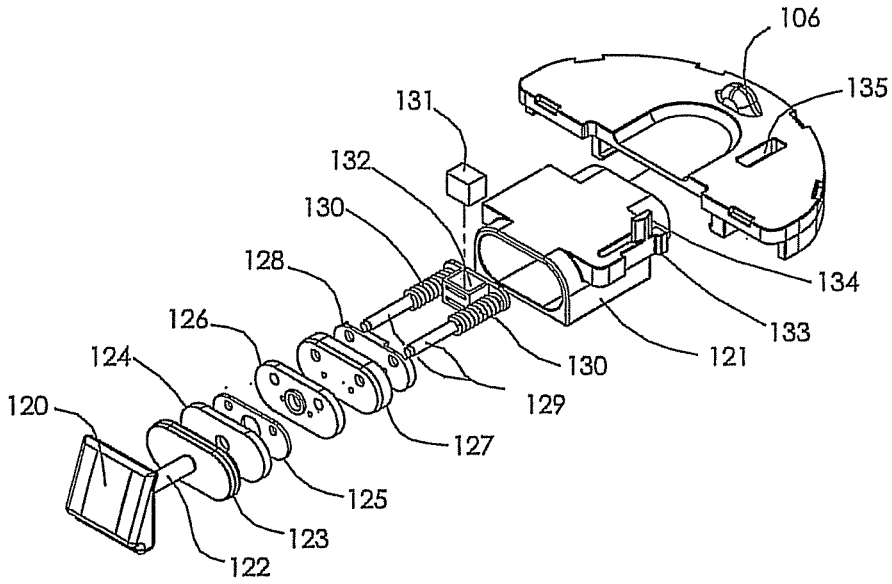
FIG. 22 is an exploded perspective view of a damping mechanism in accordance with another embodiment of the present invention.
Figure 23:
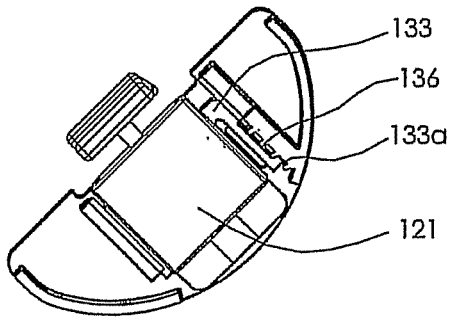
FIG. 23 is a bottom view of the damping mechanism of FIG. 22 in assembled form.

FIGS. 22 and 23 show a damping mechanism according to another embodiment of the present invention. As with the other embodiments, the damping mechanism shown in FIGS. 22 and 23 includes a cover 106 that is dimensioned so as to snap into hinge cup 3 in a fixed manner. The damping mechanism includes a slider 120 and a cylinder housing 121 and the damping mechanism is entirely contained within the hinge cup. Fixed within the cylinder housing 121 are a pair of spring guide rods 129 that carry springs 130. The slider 120 includes a cylinder rod 122 that is fixed to a piston plate 126 through a cylinder cap 123, a cylinder seal 124 and a cylinder seal support plate 125 (which is fixed to cylinder seal 124). A piston seal 127 has a piston seal support plate 128 fixed thereto, and both are connected to piston plate 126. Holes are positioned through piston seal support plate 125, piston plate 126, piston seal 127 and piston seal support plate 128 so that those parts can slide along spring guide rods 129 when slider 120 moves relative to cylinder housing 121. The cylinder cap 123 is fixed within the end opening of cylinder housing 121 so that all the parts discussed above are contained within the cylinder housing 121 in a fluid-tight manner.

The piston return springs 130 bias slider 120 away from cylinder housing 121. A fluid contained within cylinder housing 121 dampens the return stroke of slider 120 for the same reasons discussed above with respect to the other embodiments. An air bubble absorber 131 is positioned within a holding member 132 inside cylinder housing 121 so as to remove any air bubbles from the fluid contained within cylinder housing 121.

FIG. 23 shows that cylinder housing 121 includes a rearwardly extending ratchet arm 133 that includes gear teeth 133*a* that cooperate with ratchet teeth 136 formed on the bottom surface of cover 106. A tab 134 (see FIG. 22) extends upwardly from ratchet arm 133 through a hole 135 in cover 106. Once installed in a cabinet, tab 134 can be manipulated to change the position of ratchet arm 133 with respect to the ratchet teeth 136, and in turn change the extension position of cylinder housing 121, and thus slider 120, relative to the cover 106.

Figure 24:
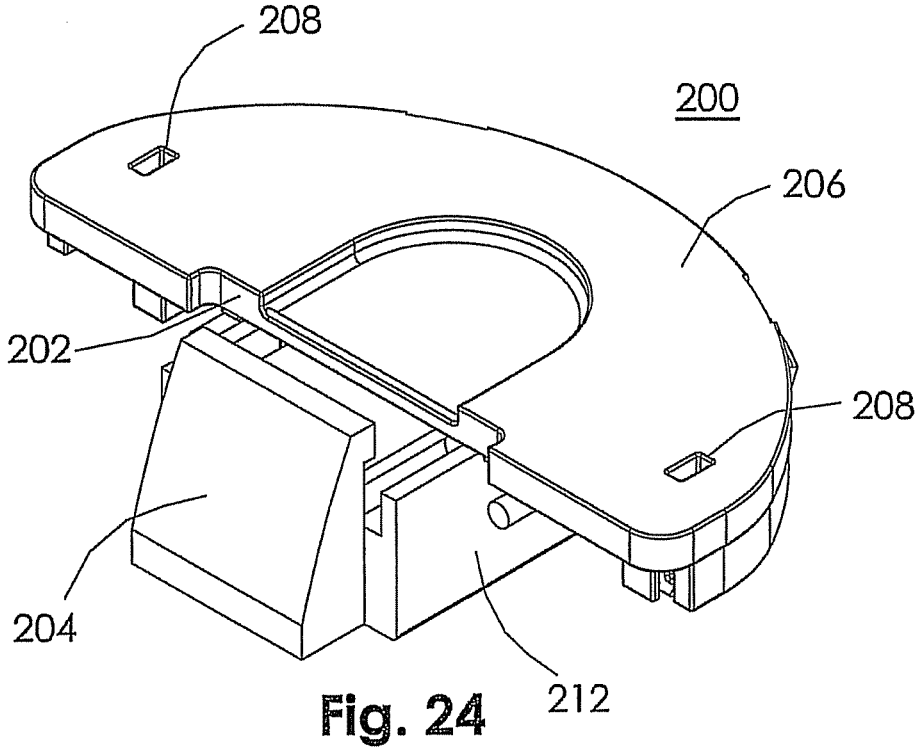
FIG. 24 is a top perspective view of a damping mechanism in accordance with another embodiment of the present invention.
Figure 25:
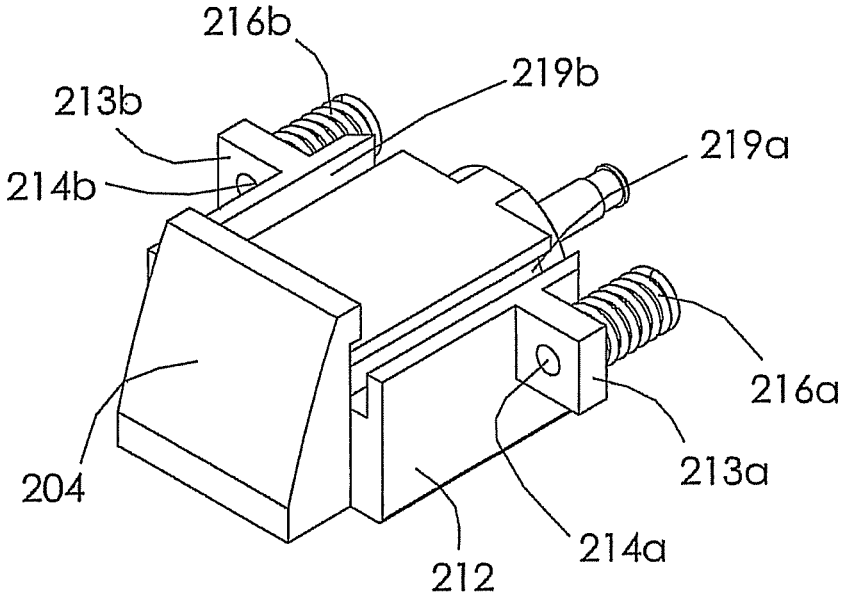
FIG. 25 is an enlarged perspective view of part of the damping mechanism shown in FIG. 24.

FIGS. 24-32 show a damping mechanism in accordance with another embodiment of the present invention. The damping mechanism includes a cover 206 and a slider housing 212 that includes an internal piston assembly and the damping mechanism is entirely contained within the hinge cup. The cover 206 in dimensioned so as to snap into a hinge cup, such as hinge cup 3, in a fixed manner. In this embodiment, the hinge cup cover 206 has a substantially half circle shape with the straight side including a notched area 202 extending substantially through the center section of the straight side, as shown in FIG. 24.

The slider housing 212 includes flange parts 213*a*, 213*b* on side surfaces and an inclined surface 204 on one end, similar to previously disclosed embodiments. The slider housing 212 also includes slide grooves 219*a*, 219*b* on an upper surface of slider housing 212.

Figure 26:
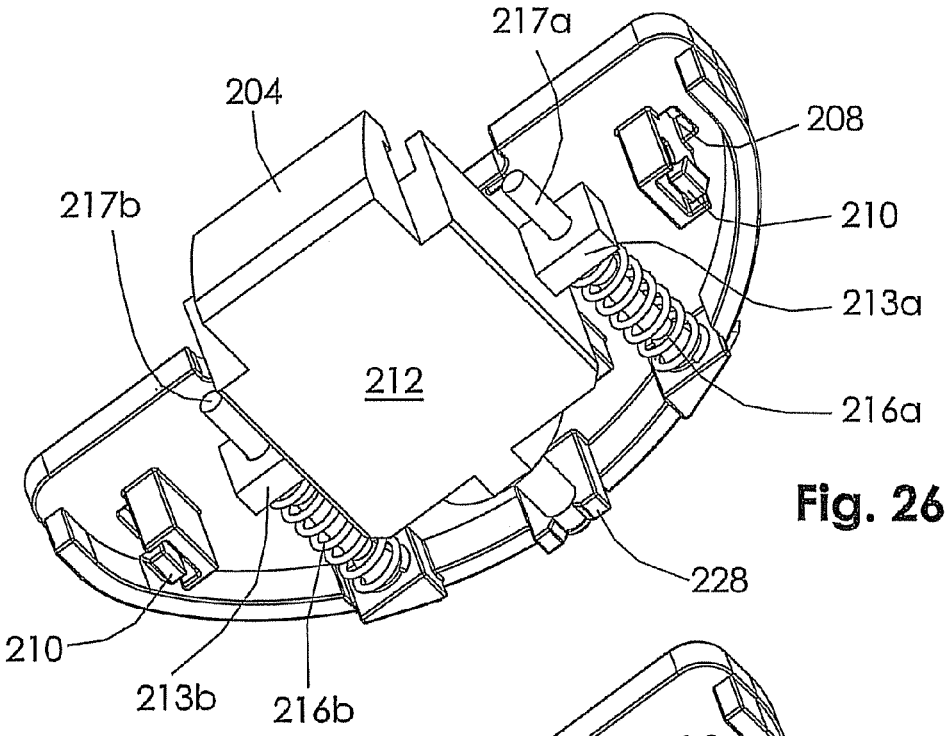
FIG. 26 is a bottom view of the damping mechanism shown in FIG. 24.

As shown in FIG. 26, when the damping mechanism 200 is inserted into a hinge cup, retaining snaps 210 engage in slots in the lower surface of the hinge cup to fix the damping mechanism 200 in the hinge cup. The retaining snaps can be released by disengaging the retaining snap 210 from the slot in the lower surface of the hinge cup. For example, in this embodiment, a thin object, such as a screwdriver, can be inserted through snap release openings 208, shown in FIGS. 24 and 26, to press down on retaining snap 210 to disengage the retaining snap 210 from the slot in the lower surface of the hinge cup.

Figure 27:
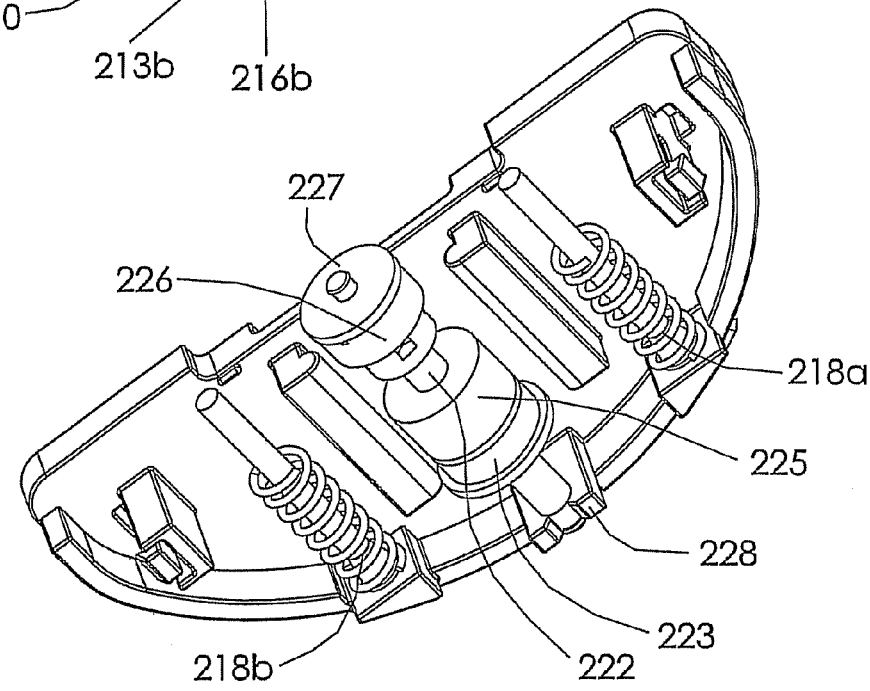
FIG. 27 is a bottom view of the damping mechanism shown in FIG. 24 with the slider housing removed.

Flange parts 213*a*, 213*b* include openings 214*a*, 214*b*. Spring guide rods 217*a*, 217*b*, which are attached to spring guide rod mounting points 218*a*, 218*b* on an interior edge of hinge cup cover 206, as shown in FIG. 27, extend through openings 214*a*, 214*b* in the flat face of flange parts 213*a*, 213*b* to extend substantially parallel to the direction of movement of slider housing 212. Springs 216*a*, 216*b* are mounted between flange parts 213*a*, 213*b* and spring guide rod mounting points 218*a*, 218*b*.

When mounted between the flat face of flange parts 213*a* and 213*b* and spring guide rod mounting points 218*a* and 218*b*, respectively, with spring guide rods 217*a* and 217*b* extending therethrough via openings 214*a* and 214*b*, respectively, springs 216*a* and 216*b* bias slider housing 212 to extend in a direction directly away from notched area 202 of hinge cup cover 206. Alternatively, in one embodiment of the present invention, springs 216*a* and 216*b* are mounted between flange parts 213*a* and 213*b* and spring guide rod mounting parts 218*a* and 218*b* without spring guide rods 217*a* and 217*b*.

Extending from the lower surface of hinge cup cover 206 are slider guides 220*a*, 220*b* that are positioned and complementarily shaped so as to be inserted into slider housing guide grooves 219*a*, 219*b* when hinge cup cover 206 is mounted into the hinge cup, as shown in FIG. 24. Slider guides 220*a*, 220*b* extend parallel to the direction of movement of slider housing 212 providing directional stability for slider housing 212.

Figure 28:
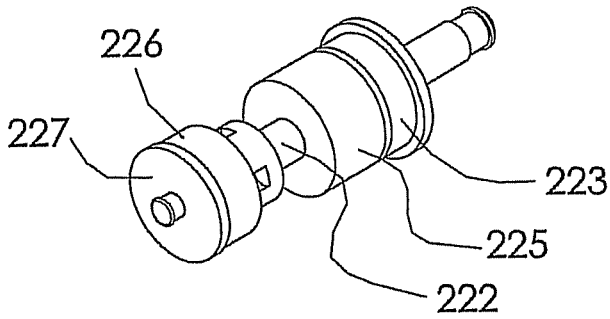
FIG. 28 is a perspective view of the piston assembly of the damping mechanism shown in FIG. 24.
Figure 29:
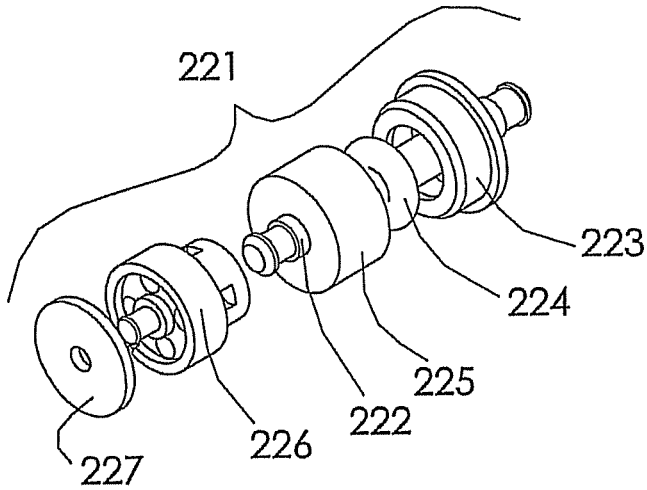
FIG. 29 is an exploded perspective view of the piston assembly of the damping mechanism shown in FIG. 24.

With reference to FIGS. 27-29, fixed within the slider housing 212 is a piston assembly which includes piston rod 222, shaft seal housing 223, o-ring 224, foam body 225, piston 226 and piston seal 227 (as shown assembled in FIG. 28 and in an exploded view in FIG. 29). The piston assembly 221 is oriented so that the piston seal 227 extends from beneath the notched area 202 of cover 206 and the piston rod 222 is fixed to cover 206 by piston rod mount 228 with shaft seal housing 223 in contact with piston rod mount 228, as shown in FIG. 27.

Figure 31:
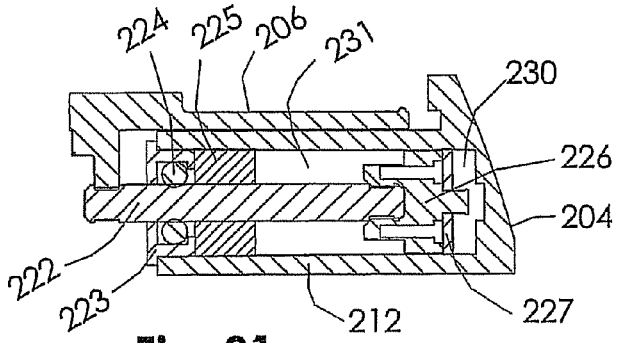
FIG. 31 is a cross-sectional view taken through line XXXI-XXXI of FIG. 30.
Figure 30:
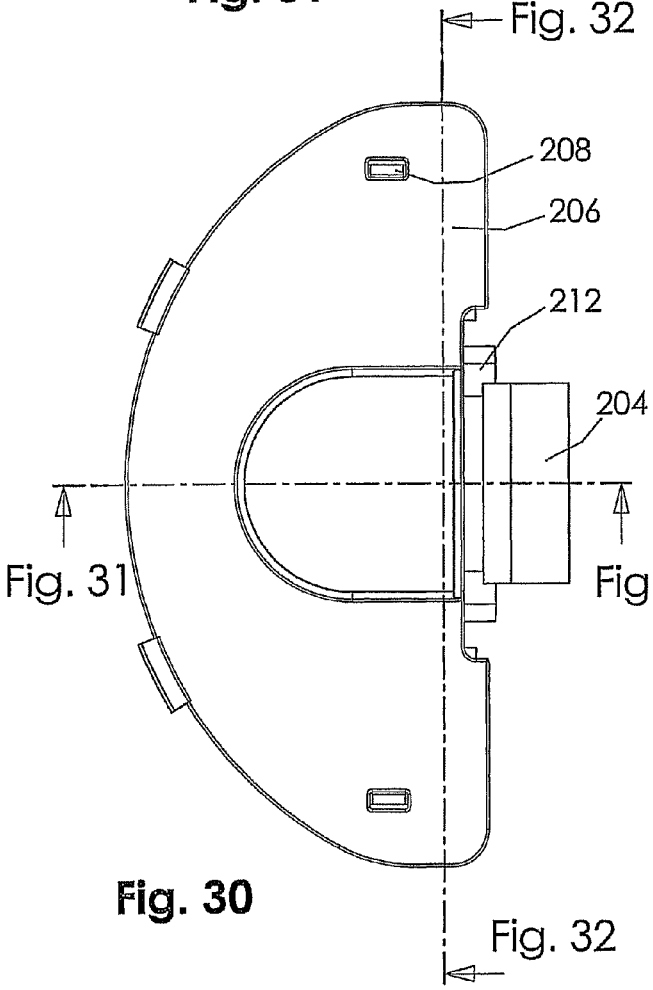
FIG. 30 is a top view of the damping mechanism shown in FIG. 24.
Figure 32:
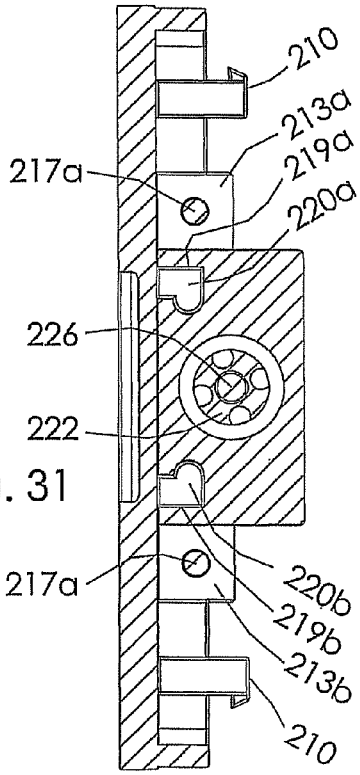
FIG. 32 is a cross-sectional view taken through line XXXII-XXXII of FIG. 30.

The piston assembly is fixed within slider housing 212 so that all the parts discussed above are contained within the slider housing 212 in a fluid-tight manner, as shown in FIG. 31. Shaft seal housing 223 and o-ring 224 provide a liquid tight barrier or seal at the open end of slider housing 212 and piston 226 and piston seal 227 reside within slider housing 212, as shown in FIG. 31. The sealed interior space contained within slider housing 212 also encompasses foam body 225, which is a bubble absorber that is attached to piston rod 222 and can move along piston rod 222 within the interior space. A damping medium, such as a viscous fluid (oil, grease) or air, is contained within the sealed interior space within slider housing 212. The piston 226 includes one or more orifices or openings through which the damping medium flows when the piston slide damper assembly 200 is actuated, as shown in FIG. 32. The orifices in piston 226 can be sized to provide the desired level of damping for cabinet doors of different sizes and weights.

Referring to FIG. 31, when the cabinet door is being closed, the dampening medium flows from a first damping medium chamber 230 around piston seal 227 and through the one or more orifices in the piston 226 into a second damping medium chamber 231. The resistance provided by the damping medium flowing around piston seal 227 and through the orifices of piston 226 dampens the movement speed or force of the cabinet door as it closes toward the cabinet housing. As the cabinet door is moved from the closed position, springs 216*a*, 216*b* bias the slider housing 212 in the opposite direction, and the medium flows in the opposite direction within slider housing 212.

While the present invention has been particularly shown and described with reference to the preferred mode as illustrated in the drawing, it will be understood by one skilled in the art that various changes in detail may be effected therein without departing from the spirit and scope of the invention as defined by the claims.

What is claimed:

1. A hinge assembly for mounting a door to a housing, comprising:
   a housing fixation section mounted to the housing;
   a hinge cup mounted to the door and pivotally connected to the housing fixation section; and
   a damping mechanism positioned entirely within the hinge cup and adapted to contact the housing fixation section and dampen the relative movement between the housing fixation section and the hinge cup as the door closes on the housing, said damping mechanism comprising a housing containing a fluid and a piston, having one or more orifices passing therethrough, arranged in the housing.

2. The hinge assembly of claim 1, wherein the damping mechanism further comprises a slider that is moveably coupled within the hinge cup.

3. The hinge assembly of claim 2, wherein the dampening mechanism further comprises a biasing member to urge the slider from a first position in the hinge cup to a second position in the hinge cup when the door is opened.

4. The hinge assembly of claim 2, further comprising a mechanism for adjusting the initial position of the slider with respect to the hinge cup.

5. The hinge assembly of claim 4, wherein the mechanism for adjusting the initial position of the slider is a cam rivet that is press fit within the hinge cup but can be rotated to an extent by an integral cam screw.

6. The hinge assembly of claim 5, wherein the damping mechanism further comprises a cover that includes a hole that allows access to the cam screw.

7. A hinge assembly for mounting a door to a housing, comprising:
   a housing fixation section mounted to the housing;
   a hinge cup mounted to the door and pivotally connected to the housing fixation section; and
   a damping mechanism positioned entirely within the hinge cup and adapted to contact the housing fixation section and dampen the relative movement between the housing fixation section and the hinge cup as the door closes on the housing, said damping mechanism comprising a slider, a biasing member, a damper including a housing containing a fluid and a piston having one or more orifices passing therethrough, and a cover, wherein the slider is moveably coupled within the hinge cup, the biasing member urges the slider in a first direction within the hinge cup, the damper dampens movement of the slider in a second direction, by movement of the fluid through the one or more orifices as the slider moves relative to the hinge cup, the second direction being opposite said first direction, within the hinge cup, and the cover holds the slider, damper and biasing member within the hinge cup.

8. The hinge assembly of claim 7, further comprising a mechanism for adjusting the initial position of the slider with respect to the hinge cup, and thus control a damping force exhibited by the damper.

9. The hinge assembly of claim 8, wherein the mechanism for adjusting the initial position of the slider is a cam rivet that is press fit within the hinge cup but can be rotated to an extent by an integral cam screw.

10. The hinge assembly of claim 9, wherein the cover includes a slot that allows access to the cam screw.

11. The hinge assembly of claim 7, wherein the biasing member is a spring.

12. A hinge assembly for mounting a door to a housing, comprising:
   a housing fixation section mounted to the housing;
   a hinge cup mounted to the door and pivotally connected to the housing fixation section; and
   a damping mechanism, positioned entirely within the hinge cup and adapted to contact the housing fixation section and dampen the relative movement between the housing fixation section and the hinge cup as the door closes on the housing, said damping mechanism comprising a cover, a slider housing moveably coupled to the cover, a biasing member, a piston having one or more orifices passing therethrough, positioned within the slider housing, and a fluid contained within the slider housing, wherein the biasing member urges the slider housing in a first direction within the hinge cup, and the piston dampens movement of the slider housing in a second direction, by movement of the fluid through the one or more orifices as the slider moves relative to the hinge cup, the second direction being opposite said first direction, within the hinge cup.

13. The hinge assembly of claim 12, wherein the slider housing comprises at least one slide groove on an upper surface thereof that is complimentary in shape to at least one slider housing guide on a lower surface of the cover to limit the direction of movement of the slider housing with respect to the cover to a single axial direction.

14. The hinge assembly of claim 12, wherein the slider housing further comprises at least one flange part on a side surface thereof that cooperates with the biasing member to urge the slider housing in said first direction within said hinge cup.

15. The hinge assembly of claim 12, wherein the piston assembly further comprises a piston rod, a shaft seal and a piston seal.

16. The hinge assembly of claim 15, wherein the piston and piston seal are fixedly attached to the cover via the piston rod.

17. A hinge assembly for mounting a door to a housing, comprising:

a housing fixation section mounted to the housing;

a hinge cup mounted to the door and pivotally connected to the housing fixation section; and a damping mechanism positioned entirely within the hinge cup and adapted to contact and dampen the relative movement between the housing fixation section and the hinge cup as the door closes on the housing, said damping mechanism comprising a slider that moves in a first direction and one or more parts that move in a second direction different from the first direction, wherein the one or more parts satisfies at least one of the following:

(i) contacts and is displaced in the second direction by a portion of the slider as the slider moves in the first direction to dampen the movement of the slider, (ii) one of the one or more, parts is contacted by a portion of the slider as the slider moves in the first direction and contacts another of the one or more parts that moves in a second direction to dampen the movement of the slider in the first direction, and (iii) rotates in the second direction and contacts a portion of the slider as the slider moves in the first direction to dampen the movement of the slider in the first direction.

18. A hinge assembly for mounting a door to a housing, comprising:

a housing fixation section mounted to the housing;

a hinge cup mounted to the door and pivotally connected to the housing fixation section; and a damping mechanism positioned entirely within the hinge cup and adapted to contact the housing fixation section and dampen the relative movement between the housing fixation section and the hinge cup as the door closes on the housing, said damping mechanism comprising a slider, a biasing member, a damper and a cover, wherein the slider is moveably coupled within the hinge cup so as to move in a first direction, the biasing member urges the slider in the first direction within the hinge cup, the damper includes one or more parts that move in a second direction different from the first direction to dampen movement of the slider in a third direction, opposite said first direction, within the hinge cup, and the cover holds the slider, damper and biasing member within the hinge cup, wherein the one or more parts satisfies at least one of the following:

contacts and is displaced in the second direction by a portion of the slider as the slider moves in the first direction to dampen the movement of the slider, (ii) one of the one or more parts is contacted by a portion of the slider as the slider moves in the first direction and contacts another of the one or more parts that moves in a second direction to dampen the movement of the slider in the first direction, and (iii) rotates in the second direction and contacts a portion of the slider as the slider moves in the first direction to dampen the movement of the slider in the first direction.

19. A hinge assembly for mounting a door to a housing, comprising:

a housing fixation section mounted to the housing;

a hinge cup mounted to the door and pivotally connected to the housing fixation section; and a damping mechanism, positioned entirely within the hinge cup and adapted to contact the housing fixation section and dampen the relative movement between the housing fixation section and the hinge cup as the door closes on the housing, said damping mechanism comprising a cover, a slider housing moveably coupled to the cover, a biasing member, and a piston assembly positioned within the slider housing, wherein the biasing member urges the slider housing in a first direction within the hinge cup, and the piston assembly dampens movement of the slider housing in a second direction by movement of a fluid within the piston assembly, opposite said first direction, within the hinge cup.

* * * * *

UNITED STATES PATENT AND TRADEMARK OFFICE

CERTIFICATE OF CORRECTION

PATENT NO. : 8,505,165 B2
APPLICATION NO. : 12/812092
DATED : August 13, 2013
INVENTOR(S) : Georg Domenig et al.

It is certified that error appears in the above-identified patent and that said Letters Patent is hereby corrected as shown below:

In the Claims

Column 13, line 21: Please add "the housing fixation section" after -- contact --

Column 14, line 15: Please add "(i)" before -- contacts --

Signed and Sealed this
First Day of October, 2013

Teresa Stanek Rea
*Deputy Director of the United States Patent and Trademark Office*